US008714936B2

(12) United States Patent
Valsecchi

(10) Patent No.: US 8,714,936 B2
(45) Date of Patent: May 6, 2014

(54) FLUID SEALING ELEMENTS AND RELATED METHODS

(75) Inventor: Pietro Valsecchi, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 24 days.

(21) Appl. No.: 13/318,991

(22) PCT Filed: May 13, 2010

(86) PCT No.: PCT/US2010/034751
§ 371 (c)(1),
(2), (4) Date: Nov. 4, 2011

(87) PCT Pub. No.: WO2011/002558
PCT Pub. Date: Jan. 6, 2011

(65) Prior Publication Data

US 2012/0087806 A1 Apr. 12, 2012

Related U.S. Application Data

(60) Provisional application No. 61/222,788, filed on Jul. 2, 2009, provisional application No. 61/239,320, filed on Sep. 2, 2009.

(51) Int. Cl.
*F04B 47/12* (2006.01)
*F04B 53/02* (2006.01)
*E21B 33/12* (2006.01)

(52) U.S. Cl.
USPC ..... 417/56; 417/555.2; 166/101; 166/105.2; 166/68

(58) Field of Classification Search
CPC ..... F04B 47/12
USPC ..... 277/423–424, 354; 166/372, 101, 105, 166/105.2, 68, 122; 92/142 R, 173; 417/56, 417/555.2, 53
See application file for complete search history.

(56) References Cited

U.S. PATENT DOCUMENTS 2,661,024 A 12/1953 Knox
2,970,547 A * 2/1961 McMurry ..... 417/57

(Continued)

OTHER PUBLICATIONS

Gloerfelt, X. et al., "Aerodynamic noise induced by laminar and turbulent boundary layers over rectangular cavities", American Institute of Aeronautics & Astronautics, 2002, AIAA 2002-2476, pp. 1-12.

(Continued)

*Primary Examiner* — Bryan Lettman
(74) *Attorney, Agent, or Firm* — ExxonMobil Upstream Research Company—Law Department

(57) ABSTRACT

Methods and mechanisms for fluid sealing are provided. The disclosed mechanisms include a tool having a cavity configured to form a toroidal vortex and a fluid sealing element to induce an azimuthal variation of the toroidal vortex (a "dynamic seal"). The fluid sealing element may include a sharp change in the axial symmetry of the cavity to induce the azimuthal variation. Some exemplary shapes of the fluid sealing element may include a notch in a cavity, a step shaped cavity, or an angular cavity in the tool. Methods for manufacturing such a dynamic seal is also provided as well as methods for producing hydrocarbons with a plunger having the dynamic seals. The tool may be a plunger, a pig, an in-flow control device, or other cylindrical device traveling through a conduit or tubular member.

28 Claims, 11 Drawing Sheets

(56) References Cited

U.S. PATENT DOCUMENTS

| | | | | |
|---|---|---|---|---|
| 3,183,470 | A | 5/1965 | Hale | |
| 4,007,784 | A | 2/1977 | Watson et al. | |
| 4,030,858 | A * | 6/1977 | Coles, Jr. | 417/56 |
| 4,410,300 | A | 10/1983 | Yerian | |
| 4,502,843 | A | 3/1985 | Martin | |
| 4,629,004 | A * | 12/1986 | Griffin | 166/372 |
| 4,929,088 | A | 5/1990 | Smith | |
| 5,427,504 | A | 6/1995 | Dinning et al. | |
| 5,880,552 | A | 3/1999 | McGill et al. | |
| 6,148,923 | A | 11/2000 | Casey | |
| 6,176,309 | B1 | 1/2001 | Bender | |
| 6,200,103 | B1 * | 3/2001 | Bender | 417/56 |
| 6,209,637 | B1 | 4/2001 | Wells | |
| 6,467,541 | B1 | 10/2002 | Wells | |
| 6,484,971 | B2 | 11/2002 | Layukallo | |
| 6,644,399 | B2 | 11/2003 | Abbott et al. | |
| 6,732,766 | B2 | 5/2004 | Charron | |
| 7,093,652 | B2 | 8/2006 | Gray et al. | |
| 7,121,335 | B2 | 10/2006 | Townsend | |
| 7,243,730 | B2 | 7/2007 | Casey | |
| 7,296,411 | B2 | 11/2007 | Segota et al. | |
| 7,383,878 | B1 | 6/2008 | Victor | |
| 2005/0022998 | A1 | 2/2005 | Rogers, Jr. | |
| 2007/0001134 | A1 | 1/2007 | Lonnes | |
| 2009/0188673 | A1 | 7/2009 | Hearn et al. | |
| 2012/0132437 | A1 | 5/2012 | Gong et al. | |

OTHER PUBLICATIONS

Miles, J.W. et al., "Helmholtz resonance of harbours", J. Fluid Mech., 1975, v. 67(Part 3), pp. 445-464.

O'Brien, V., "Closed Streamlines Associated with Channel Flow over a Cavity", The Physics of Fluids, 1972, v.15(12), pp. 2089-2097.

Yao, H. et al., "Computation of incompressible flow over three-dimensional cavities", *Advances in Fluid Mechanics III*, 2000, pp. 125-133, WIT Press.

Yao, H. et al., "Incompressible Laminar Flow Over a Three-Dimensional Rectangular Cavity", J. of Thermal Science, 2000, v. 9(3), pp. 199-204.

* cited by examiner

800

820

FLUID SEALING ELEMENTS AND RELATED METHODS

CROSS-REFERENCE TO RELATED APPLICATIONS

This application is the National Stage of International Application No.

PCT/US10/34751, filed 13 May 2010, which claims the benefit of U.S. Provisional Patent Application 61/222,788, filed 2 Jul. 2009, and U.S. Provisional Patent Application 61/239,320 filed Sep. 2, 2009, both entitled FLUID SEALING ELEMENTS AND RELATED METHODS, the entirety of which are incorporated by reference herein.

TECHNOLOGY FIELD

Embodiments of the invention relate to methods and systems for generating an effective dynamic seal. More particularly, embodiments of the invention relate to methods and systems for generating an azimuthal variation of a toroidal vortex in a fluid flowing around a tool to form an effective fluid seal.

TECHNICAL BACKGROUND

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Dynamic sealing between two moving surfaces is applicable to many applications, including the travel of a cylindrical body through a tubular element. In the oil and gas industry, examples include a plunger in a well production tubing member, a pig through a production line, and Inflow Control Devices (ICDs). In such systems, as limited contact may be desirable in order to minimize the friction drag or to avoid the risk of the device being stuck, a flow region is present in the annulus between the two concentric cylinders that are in relative motion. In some cases, there may be a desire to control the pressure drop along the annulus as a means to control, for example, the flow of fluid from the region above the device and the region below it. In other cases, there may be the desire to minimize such flow in order to achieve a practical separation between the two regions.

One solution is disclosed in U.S. Pat. No. 6,200,103 (the '103 reference), which consists of cutting circular slots in the outer surface of the tool. The '103 reference suggests that the opening of such cavities would force the flow to generate some sort of toroidal vortices that are associated with additional friction and that, consequently, will increase the resistance to the flow in the gap between the plunger and the walls. Such cavities are commonly referred to as "turbulent sealers." Although the idea was useful, the behavior of the flow inside the cavities as it is indicated in the '103 reference may not be correct (the direction of the streamlines is more complex than what is shown and depends on various parameters), thus indicating some lack of understanding of this type of fluid flow.

What is needed are methods and systems for generating an effective dynamic seal in a tool taking advantage of the fluid flow around the tool.

Other relevant material may be found in: Cooper R. K. and Raghunathan S. R., "Computation of Incompressible Flow Over Three-Dimensional Cavities," Third International Conference on Advances in Fluid Mechanics (AFM'2000); Yao, H, Cooper, R. K., and Raghunathan, S. R., Incompressible laminar flow over a three-dimensional rectangular cavity, Journal of Thermal Science, Volume 9, Number 3, 2007; Miles, J. W. and Lee, Y. K., "Helmholtz Reonance of Harbors," Journal of Fluid Mechanics, 67, pp. 445-467, (1959); O'Brien V., "Closed Streamlines Associated with Channel Flow Over a Cavity," Physics of Fluids, 15, No. 12, (1972).

SUMMARY

In one embodiment of the present invention, a sealing mechanism is provided. The sealing mechanism includes a tool having at least one cavity in an outer surface of the tool having a cavity geometry configured to generate a toroidal vortex; and a fluid sealing element in the cavity configured to induce an azimuthal variation of the toroidal vortex.

In particular embodiments of the sealing mechanism, the tool has a cylindrical shape and an axial length and is configured to move within an inside surface of a conduit at a linear velocity with respect to the conduit and form a gap between the outer surface of the tool and the inner surface of the conduit; and the fluid sealing element is a sharp disruption of an axial symmetry of the cavity geometry. In particular, the sharp disruption is a change in an orientation of the cavity geometry of at least about 30° from the azimuthal direction; the sharp disruption is positioned on the cavity at a location selected from the group consisting of: a front (leading) edge of the cavity; a back edge of the cavity; a depth of the cavity; and any combination thereof; and the fluid sealing element is selected from the group consisting of: a step shape, a "V" shape, a notch, and any combination thereof.

In more particular embodiments, the sealing mechanisms may further include the following optimizations: i) the cavity is at least as deep as one half of the gap; ii) the cavity has an axial length parallel to the axial length of the tool and the axial length of the cavity is about 1.5 times the gap; and iii) multiple cavities with each cavity having multiple fluid sealing elements, wherein the fluid sealing element of a first cavity is not in axial alignment with the fluid sealing element of a successive cavity. In particular, exemplary cases, the tool may be a plunger and the conduit is a high-rate gas producing well.

In a second embodiment of the invention, a method of manufacturing a tool with a sealing mechanism is provided. The method includes providing the tool, the tool having at least one cavity in the outer surface of the tool having a cavity geometry configured to generate a toroidal vortex; and forming at least one fluid sealing element for inducing an azimuthal variation of the toroidal vortex in the cavity geometry.

In a third embodiment of the invention, an alternative method of manufacturing a tool with a sealing mechanism is provided. The method includes forming a tool having at least one cavity in the outer surface of the tool having a cavity geometry and a fluid sealing element, the fluid sealing element configured to generate an azimuthal variation of a toroidal vortex in the cavity geometry.

Particular embodiments of the second and third embodiments of the invention may include the tool has a cylindrical shape and an axial length and is configured to move within an inside surface of a conduit at a linear velocity with respect to the conduit and form a gap between the outer surface of the tool and the inner surface of the conduit; and the fluid sealing element is a sharp disruption of an axial symmetry of the cavity geometry. More particular embodiments may provide that the sharp disruption is a change in an orientation of the cavity geometry of at least about 30° from the azimuthal direction; and the sharp disruption is positioned on the cavity at a location selected from the group consisting of: a front edge of the cavity; a back edge of the cavity; a depth of the cavity; and any combination thereof.

In a more particular embodiment of the second embodiment, the fluid sealing element is a notch in a leading edge of the cavity.

In a more particular embodiment of the third embodiment the fluid sealing element is selected from the group consisting of: a step shape in the cavity geometry, a "V" shape in the cavity geometry, a notch in the cavity geometry, and any combination thereof.

In more particular embodiments of the second and third embodiments of the invention, the sealing mechanisms may further include the following optimizations: i) the cavity is at least as deep as one half of the gap; ii) the cavity has an axial length parallel to the axial length of the tool and the axial length of the cavity is about 1.5 times the gap; and iii) multiple cavities with each cavity having multiple fluid sealing elements, wherein the fluid sealing element of a first cavity is not in axial alignment with the fluid sealing element of a successive cavity. In particular, exemplary cases, the tool may be a plunger and the conduit is a high-rate gas producing well.

In a fourth embodiment of the invention, a method of producing hydrocarbons is provided. The method includes operating a plunger artificial lift system in a gas producing well having produced gas and produced liquids; using a plunger in the plunger artificial lift system comprising a sealing mechanism, where the sealing mechanism includes: at least one cavity in an outer surface of the plunger having a cavity geometry configured to generate a toroidal vortex; and a fluid sealing element in the cavity for inducing an azimuthal variation of the toroidal vortex.

In particular embodiments of the fourth embodiment, the fluid sealing element is a sharp disruption of an axial symmetry of the cavity geometry. More particular embodiments may provide that the sharp disruption is a change in an orientation of the cavity geometry of at least about 30° from the azimuthal direction; and the sharp disruption is positioned on the cavity at a location selected from the group consisting of: a front edge of the cavity; a back edge of the cavity; a depth of the cavity; and any combination thereof. Even more particularly, the fluid sealing element is selected from the group consisting of: a step shape, a "V" shape, a notch, and any combination thereof; and i) the cavity is at least as deep as one half of the gap; ii) the cavity has an axial length parallel to the axial length of the tool and the axial length of the cavity is about 1.5 times the gap; and iii) the plunger further comprising multiple cavities with each cavity having multiple fluid sealing elements, wherein the fluid sealing element of a first cavity is not in axial alignment with the fluid sealing element of a successive cavity.

BRIEF DESCRIPTION OF THE DRAWINGS

The foregoing and other advantages of the present disclosure may become apparent upon reviewing the following detailed description and drawings of non-limiting examples of embodiments in which.

DETAILED DESCRIPTION

Figure 1:
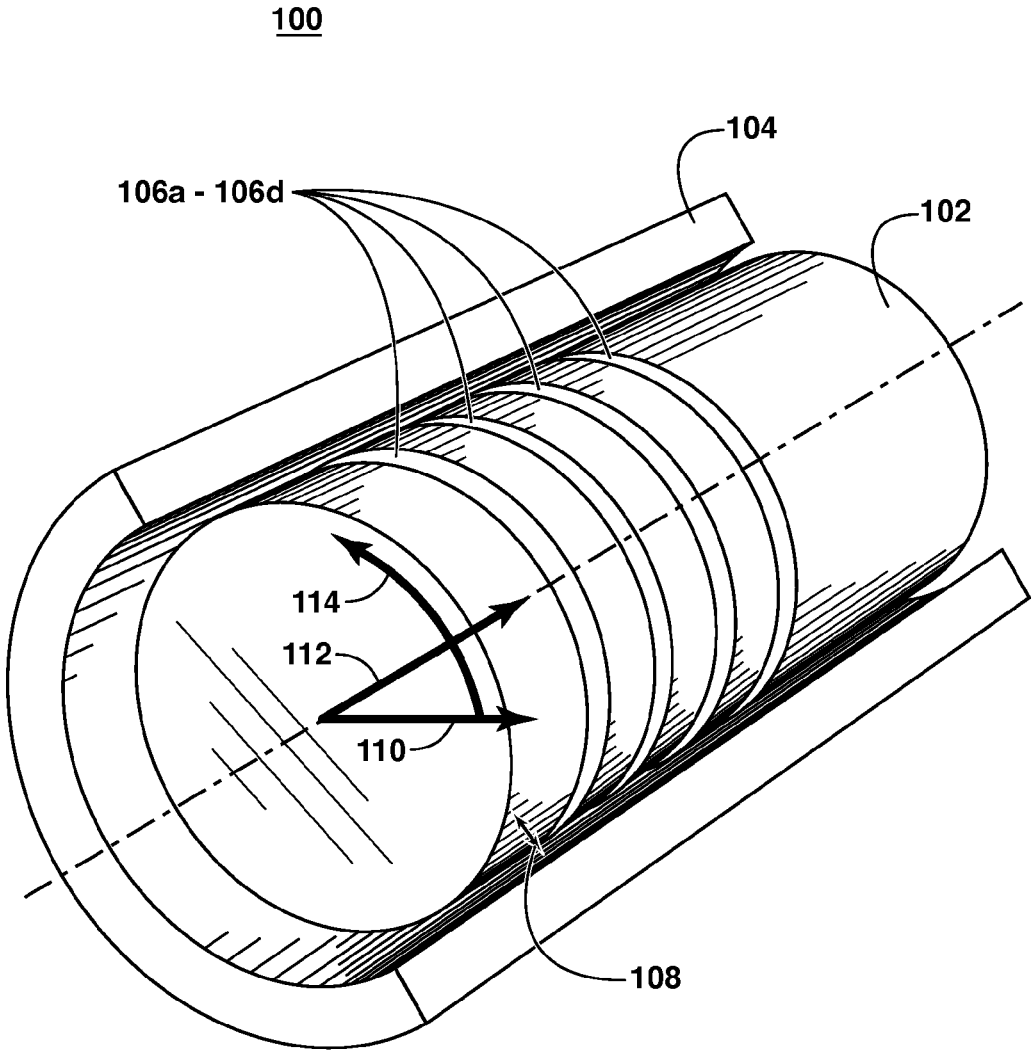
FIG. 1 is a rendering of a tool with turbulent sealers located in a conduit.

In the following detailed description section, the specific embodiments of the present disclosure are described in connection with preferred embodiments. However, to the extent that the following description is specific to a particular embodiment or a particular use of the present disclosure, this is intended to be for exemplary purposes only and simply provides a description of the exemplary embodiments. Accordingly, the disclosure is not limited to the specific embodiments described below, but rather, it includes all alternatives, modifications, and equivalents falling within the true spirit and scope of the appended claims.

Definitions

Various terms as used herein are defined below. To the extent a term used in a claim is not defined below, it should be given the broadest definition persons in the pertinent art have given that term as reflected in at least one printed publication or issued patent.

The terms "a" and "an," as used herein, mean one or more when applied to any feature in embodiments of the present inventions described in the specification and claims. The use of "a" and "an" does not limit the meaning to a single feature unless such a limit is specifically stated.

The term "about" is intended to allow some leeway in mathematical exactness to account for tolerances that are acceptable in the trade. Accordingly, any deviations upward or downward from the value modified by the term "about" in the range of 1% to 10% or less should be considered to be explicitly within the scope of the stated value.

The term "cavity," as used herein, means an indentation, cut, or recess in an outer surface of a tool.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The term "exemplary" is used exclusively herein to mean "serving as an example, instance, or illustration." Any embodiment described herein as "exemplary" is not necessarily to be construed as preferred or advantageous over other embodiments.

The terms "preferred" and "preferably" refer to embodiments of the inventions that afford certain benefits under certain circumstances. However, other embodiments may also be preferred, under the same or other circumstances. Furthermore, the recitation of one or more preferred embodiments does not imply that other embodiments are not useful, and is not intended to exclude other embodiments from the scope of the inventions.

The terms "substantial" or "substantially," as used herein, mean a relative amount of a material or characteristic that is sufficient to provide the intended effect. The exact degree of deviation allowable may in some cases depend on the specific context.

The term "tool," as used herein, means a physical object that has a useful purpose.

The term "turbulent sealer," as used herein, means a cavity in the outer surface of a tool configured to induce the formation of a steady toroidal (circular) vortex (also referred to as a "simple cavity vortex") in the cavity when a fluid passes over the surface of the tool.

The definite article "the" preceding singular or plural nouns or noun phrases denotes a particular specified feature or particular specified features and may have a singular or plural connotation depending upon the context in which it is used.

DESCRIPTION OF EMBODIMENTS

Embodiments of the present invention provide a sealing mechanism in a tool. The tool includes at least one cavity in the outer surface of the tool having a cavity geometry configured to generate a toroidal vortex; and a fluid sealing element for inducing an azimuthal variation of the toroidal vortex (e.g. a "dynamic seal"). This approach can be applied to a variety of tools such as plungers for use in artificial lift systems, pigs for use in production lines that may form wax or other deposits, and in-flow control devices for use in hydrocarbon operations. Numerous optimizations regarding the size, shape, and placement of the fluid sealing element and the cavity or cavities as will be disclosed when discussing particular exemplary embodiments of the methods and systems.

In another embodiment, a first method of manufacturing a tool having a sealing mechanism is provided. The method includes providing a tool having at least one cavity in the outer surface of the tool having a cavity geometry configured to generate a toroidal vortex; and forming at least one fluid sealing element for inducing an azimuthal variation of the toroidal vortex in the cavity geometry. This method is well suited for modification of existing tools that have no sealing mechanism, such as by placing notches into the front or leading edge of a uniform cavity. This converts the cavity from one that forms a steady toroidal (circular) vortex (also referred to as a "simple cavity vortex") to one that induces an azimuthal variation in the toroidal vortex (also referred to as a "three dimensional vortex").

Alternatively, a second method of manufacturing a tool having a sealing mechanism is provided. The method includes forming a tool having at least one cavity in the outer surface of the tool having a cavity geometry and a fluid sealing element, the fluid sealing element configured to generate an azimuthal variation of a toroidal vortex in the cavity geometry. This method may be utilized for building a tool from scratch where one may control the shape of the entire cavity to form a step-shaped cavity or a "V" shaped cavity, form notches in the cavity, or some combination. Other "sharp" shapes may also be employed, so long as they are sufficient to form interactions between the vortexes in adjacent cavities.

A method of producing hydrocarbons is also provided. The method includes operating a plunger artificial lift system in a gas producing well having produced gas and produced liquids; using a plunger in the plunger artificial lift system comprising a sealing mechanism. The sealing mechanism includes at least one cavity in an outer surface of the plunger having a cavity geometry configured to generate a toroidal vortex; and a fluid sealing element in the cavity for inducing an azimuthal variation of the toroidal vortex. Such a method is expected to increase the pressure drop between a front edge of the plunger to the rear edge of the plunger, which should provide for a more efficient separation of water and gas in the gas producing well.

Referring now to the figures, FIG. 1 is a rendering of a tool with turbulent sealers located in a conduit. The illustration 100 includes the tool 102, a conduit 104, a plurality of cavities (also called "turbulent sealers" or "slots") 106*a*-106*d*, an arrow 108 indicating the gap between the tool 102 and the conduit 104 an arrow 110 pointing in the radial direction, an arrow 112 pointing in the axial direction, and an arrow 114 pointing in the azimuthal or angular direction. In this exemplary rendering, the cavities or turbulent sealers 106 are axial-symmetric (e.g. of a uniform axial width, uniform radial depth, and uniform azimuthal displacement) like the configuration disclosed in U.S. Pat. No. 6,200,103 (the '103 reference).

Figure 2A:
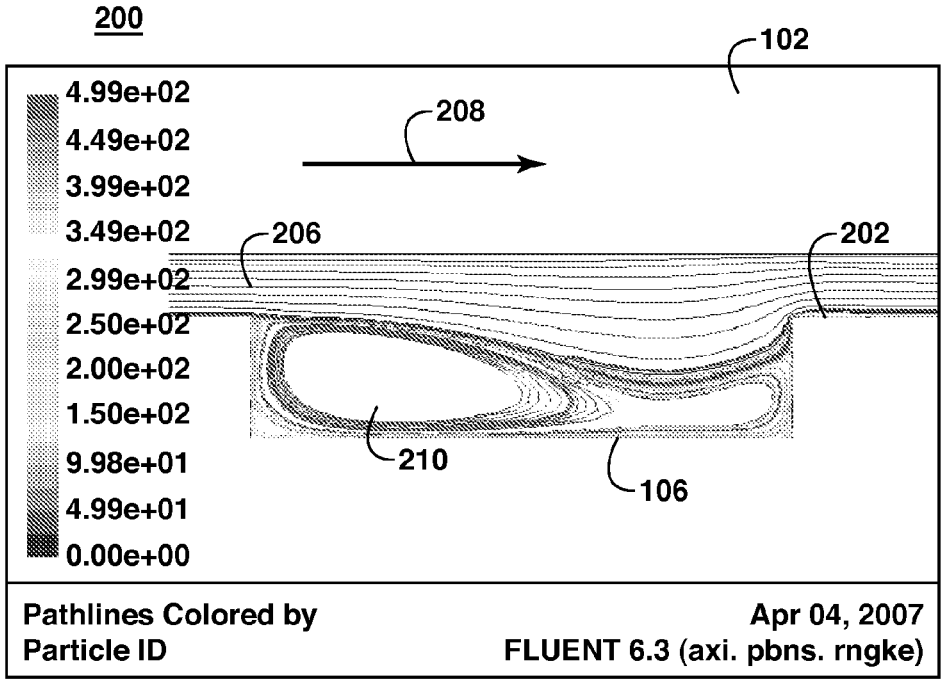
FIG. 2A is an illustration of a simple cavity vortex in the cavity of the tool of FIG. 1.

FIG. 2A is an illustration of a simple cavity vortex in the cavity of the tool of FIG. 1. As such, FIG. 2A may be best understood with reference to FIG. 1. The illustration 200 shows a tool 102 with an outer surface 202 and a cavity 106 therein having a sharp front edge 206. Also shown is a fluid flow 208 over the outer surface 102, and a simple cavity vortex 210 inside the cavity 106. This is the type of vortex generated by an axial-symmetric cavity 106. This solution does not offer a complete sealing, since a limited flow exists through the external gap 108, whereby the pressure drop grows with the square of the flow velocity through the gap. The efficiency of the tool is directly related to the sealing properties of the gap flow between the tool and the conduit. As shown by the streamlines shown in illustration 200, these axial-symmetric cavities result in the formation of steady circular vortices in the cavity 106.

In one particular application of these "turbulent sealers," the tool 102 is a plunger in a gas lift well and the outer diameter of the plunger is calculated to maintain a minimal gap between the plunger and the well (e.g. production) pipe. When the plunger moves upwards and carries a water column, part of the water leaks through the gap between the plunger and the pipe. Adding turbulent sealers to the plunger increases the pressure drop and decreases the amount of water that leaks through the gap, as will be shown below.

Figure 2B:
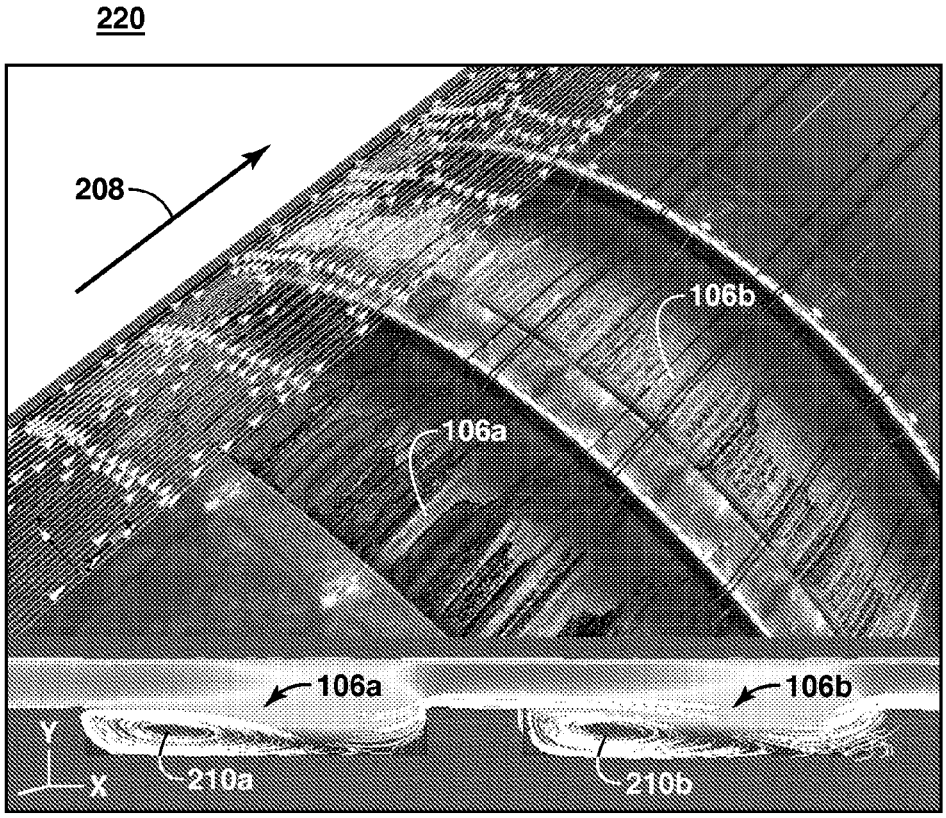
FIG. 2B is an illustration of a first and a second simple cavity vortex like that shown in FIG. 2A in a first and second cavity of the tool of FIG. 1, respectively.

FIG. 2B is an illustration of a first and a second simple cavity vortex like that shown in FIG. 2A in a first and second cavity the tool of FIG. 1, respectively. As such, FIG. 2A may be best understood with reference to FIGS. 1 and 2A. The illustration 220 includes an isometric view 222 of the fluid flow 208 through the first cavity 106*a* and the second cavity 106*b* and a side view of the same showing a first simple cavity vortex 210*a* in the first cavity 106*a* and a second simple cavity vortex 210*b* in the second cavity 106*b*. The illustration shows that there is not much of a difference between the shape of the simple cavity vortex 210*a* in the first cavity 106*a* and the shape of the simple cavity vortex 210*b* in the second cavity 106*b*.

Figure 2C:
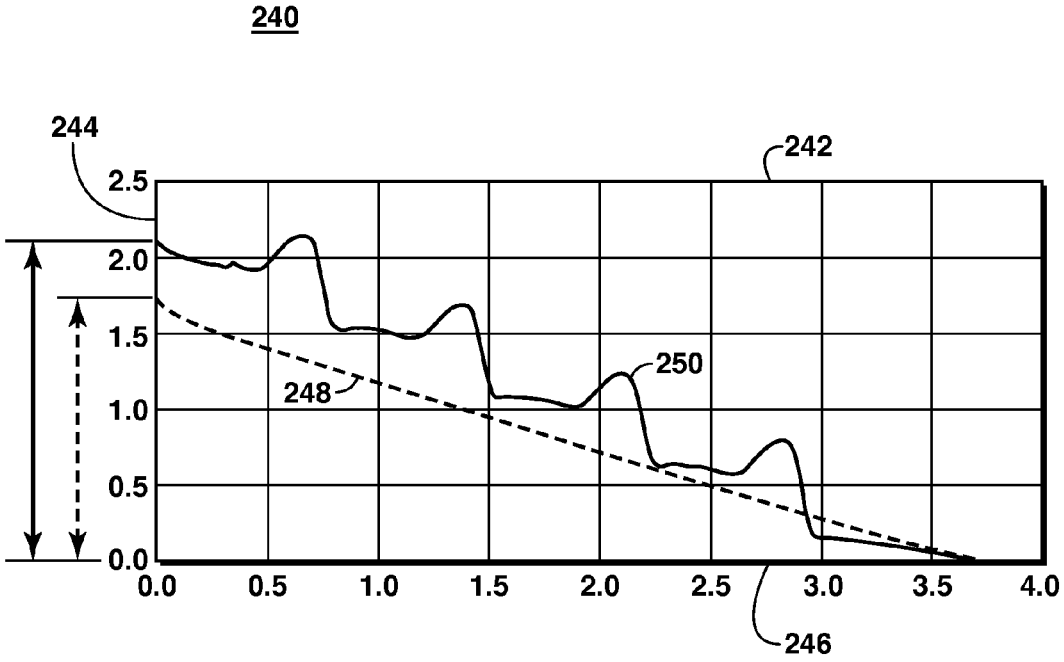
FIG. 2C is an illustration comparing the pressure drop of a tool having a straight gap and the tool of FIG. 1.

FIG. 2C is an illustration comparing the pressure drop of a tool having a straight gap and the tool of FIG. 1. As such, FIG. 2C may be best understood with reference to FIG. 1. The graph 240 compares pressure 244 and location 246 along the tool. The straight line plot 248 is the pressure along the length of a tool having a straight gap between the tool and a conduit. The peaked line plot 250 is the pressure along the length of the tool 102 having four turbulent sealers 106*a*-106*d* along its length.

By comparing the evolution of the pressure 244 along the gap 108 for the case of a straight cylinder 248 to the case of a cylinder with four "turbulent sealers," it can be observed that the same flow of fluids determines a higher pressure differential when the "turbulent sealers" are present. This indeed corresponds to a higher sealing efficiency. In the plot, jumps in the pressure are detected at the locations of the cavities 106*a*-106*d*, thus illustrating how the presence of a large vortex absorbs energy from the flow 208 and requires larger pressure differential to push the fluid through the gap 108. It can also be observed, however, that the height of the pressure jump is the same for all cavities 106*a*-106*d*. This indicates that the vortices 210*a*-210*d* are independent from each other and that the effects due to the presence of a cavity do not extend beyond the cavity itself.

In more general terms, the use of axial-symmetric cavities 106 promote the use of a single, toroidal vortex in each cavity in order to increase the resistance to the flow in the gap 108. It fails, however, to fully exploit the possibilities of turbulence and does not admit the possibility of interaction effects between the vortices from different cavities.

Figure 3A:
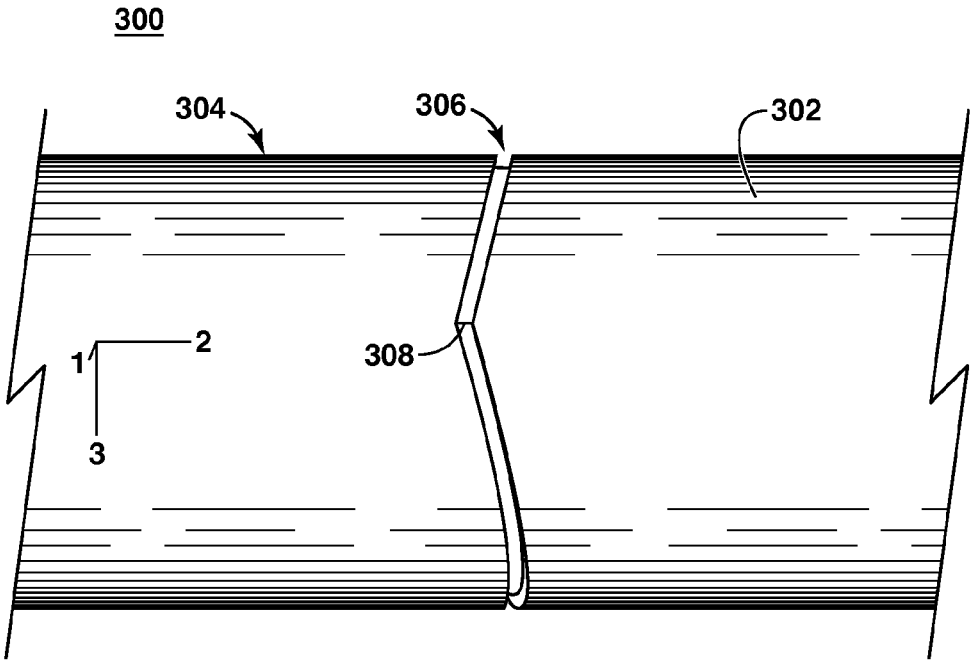
FIGS. 3A-3C illustrate three particular embodiments of certain aspects of the presently disclosed sealing mechanism.
Figure 3B:
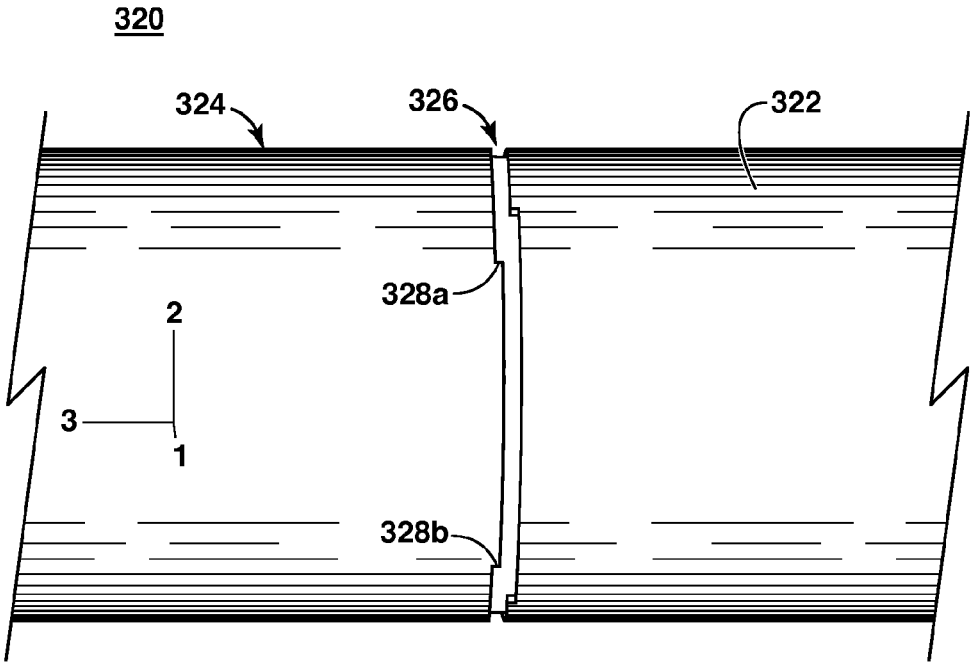
Figure 3C:
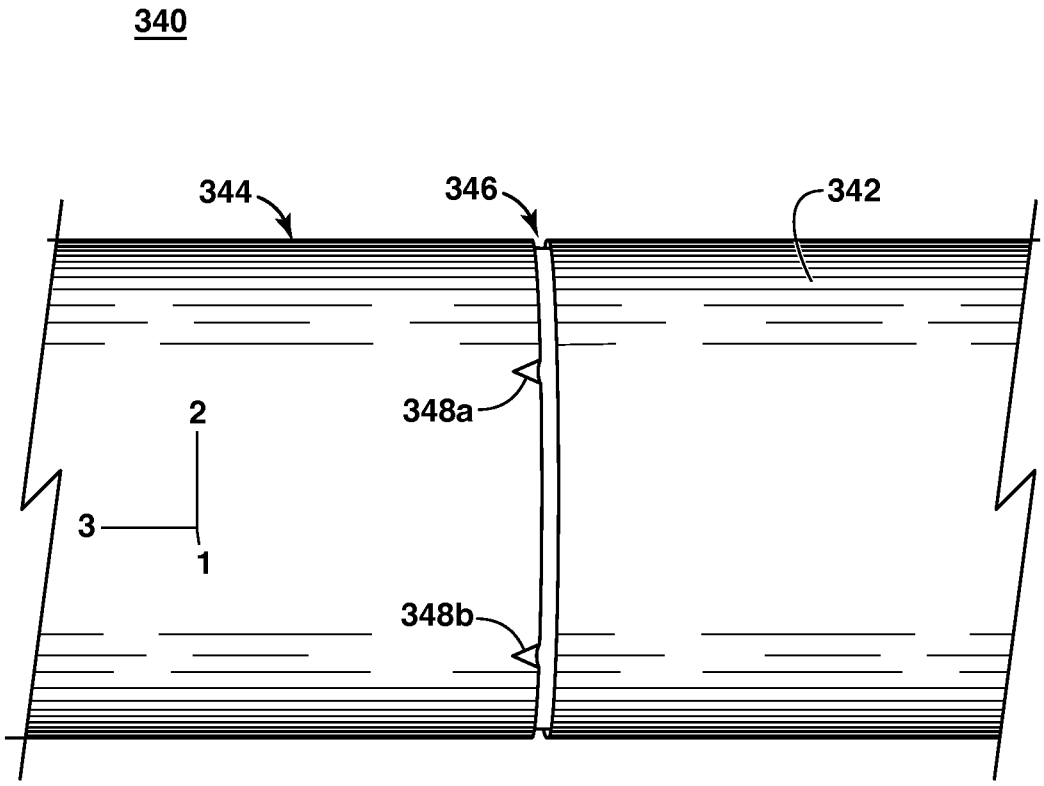

FIGS. 3A-3C illustrate three particular embodiments of certain aspects of the presently disclosed sealing mechanism. In FIG. 3A, the illustration 300 includes a tool 302 having an outer surface 304 and a cavity 306 with a cavity geometry configured to generate a toroidal vortex and a fluid sealing element 308 in the cavity 306 for inducing an azimuthal variation of the toroidal vortex. As can be seen, the fluid sealing element 308 is an angular cut in the shape of the cavity 306. So, in this particular embodiment, the cavity 306 is cut at an angle from the azimuthal direction with a sharp change in the direction at two opposite points. Note that, although only one V shaped point is shown, there may be more than one fluid sealing element for each cavity 306 in the tool 302.

In FIG. 3B, the illustration 320 includes a tool 322 having an outer surface 324 and a cavity 326 with a cavity geometry configured to generate a toroidal vortex and a fluid sealing element 328*a*-328*b* in the cavity 326 for inducing an azimuthal variation of the toroidal vortex. As shown, the fluid sealing element 328*a*-328*b* is a step shape in the cavity 326. Note that, although two step shapes 328*a*-328*b* are shown, there may be one or more than two step shapes 328*a*-328*b* for each cavity 306.

In FIG. 3C, the illustration 340 includes a tool 342 having an outer surface 344 and a cavity 346 with a cavity geometry configured to generate a toroidal vortex and a fluid sealing element 348*a*-348*b* in the cavity 346 for inducing an azimuthal variation of the toroidal vortex. As shown, the fluid sealing element 348*a*-348*b* is a plurality of notches in an edge of the cavity 346. Note, that although two notches 348*a*-348*b* are shown, there may be one or more than two notches 348*a*-348*b* for each cavity 346.

For each of the illustrated embodiments 300, 320, and 340, they are all designed to disrupt the axial-symmetry of the cavities 306, 326, and 346. This is accomplished by introducing changes in the geometry of the cavity in the azimuthal direction, such as (but not limited to) changes in the depth, the width, and the fluid-dynamic orientation of the cavity (e.g. cavities 306, 326, and 346). The disruption of axial-symmetry in the cavity corresponds to the disruption of axial-symmetry in the vortex (e.g. vortex 210) that, in particular cases, can give rise to a more complex and three-dimensional system of vortices. One beneficial advantage of such a flow-dynamic configuration is that the complex system of vortices is associated to a larger energy level than the single vortex or, conversely, that the flow in the gap (e.g. gap 108) needs more energy to maintain it. Alternatively stated, if the flow in the gap generates a more complex system of vortices, it will experience a larger pressure drop along the gap, corresponding to a more efficient sealing capability.

In one particular preferred embodiment, sharp changes in the direction of the cavity are introduced. A large number of configurations are possible. The illustrated embodiments 300, 320, and 340 are only three specific examples of fluid sealing element configured to induce an azimuthal variation of the toroidal vortex. Sharp angles, in fluid dynamics, are related to discontinuities in the flow topology. In more common terms, the presence of sharp angles in the geometry of the cavity generates additional vortices which, in the present disclosure, introduce additional complexity to the vortical structure. Note that sharp angles that are not aligned with the azimuthal direction produce vortices that are oriented in the streamwise direction (the axial direction 112, in FIG. 1).

Figure 4A:
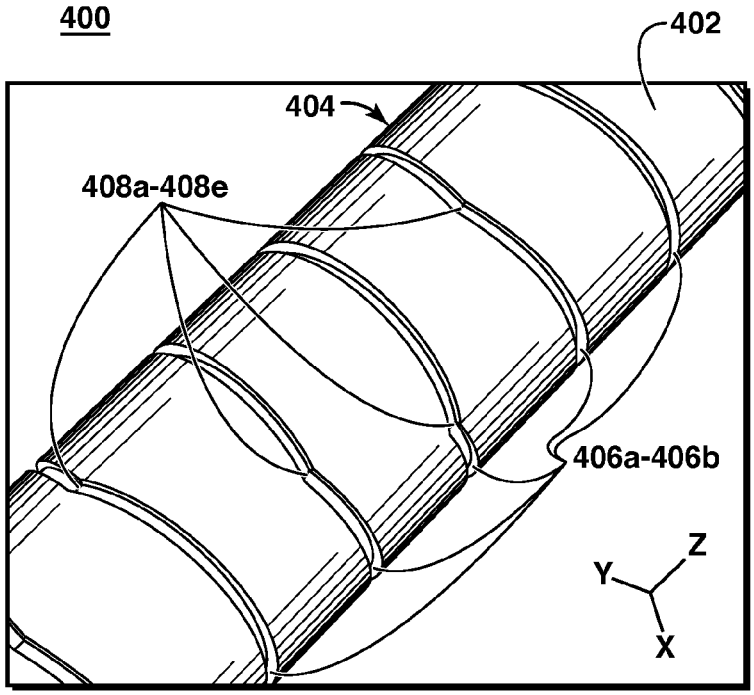
FIGS. 4A-4C illustrate three alternative embodiments of the sealing mechanisms disclosed in FIGS. 3A-3C, respectively.
Figure 4B:
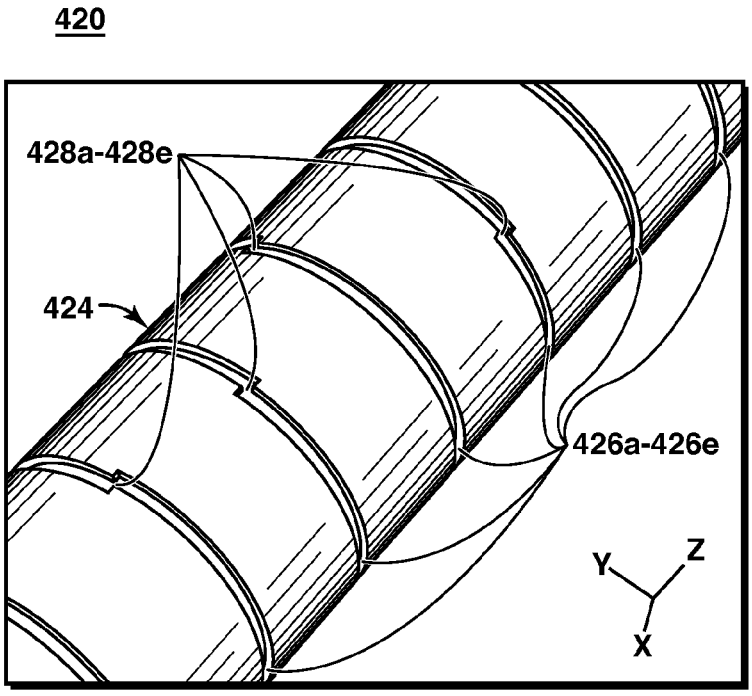
Figure 4C:
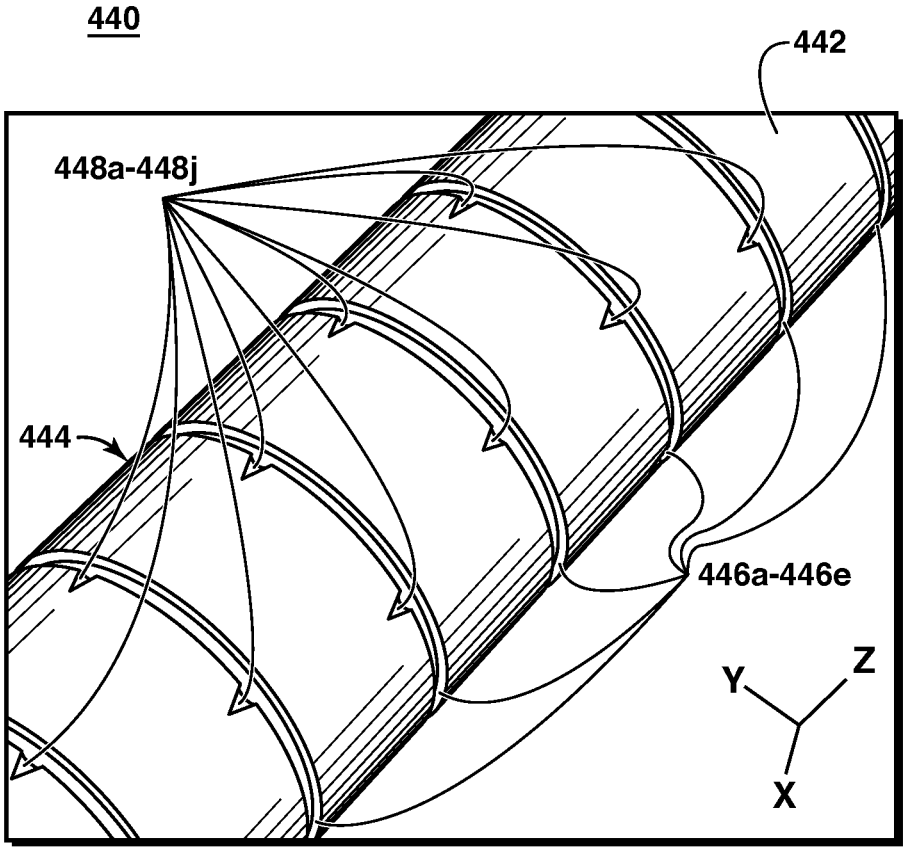

FIGS. 4A-4C illustrate three alternative embodiments of the sealing mechanisms disclosed in FIGS. 3A-3C, respectively. As such, FIGS. 4A-4C may be best understood with reference to FIGS. 3A-3C. FIG. 4A is an illustration 400 including a tool 402 having an outer surface 404 and a plurality of cavities 406*a*-406*e* with a cavity geometry configured to generate a toroidal vortex and at least one fluid sealing element 408*a*-408*e* in each of the cavities 406*a*-406*e* for inducing an azimuthal variation of the toroidal vortex. Note that, although five cavities 406*a*-406*e* and five fluid sealing elements 408*a*-408*e* are indicated, this is for illustrative purposes only and should not be taken as an indication of a preferred embodiment. Further, when the single reference number is used to describe a cavity 406 or fluid sealing element 408, it may indicate one, some, or all of the cavities and fluid sealing element of the tool 402. As can be seen, the fluid sealing element 408 is an angular cut in the shape of the cavity 406. So, in this particular embodiment, the cavity 406 is cut at an angle from the azimuthal direction with a sharp change in the direction at two opposite points. Note that, although only one V shaped point 408 is shown for each cavity 406, there may be more than one fluid sealing element 408 for each cavity 406 in the tool 402.

FIG. 4B is an illustration 420 including a tool 422 having an outer surface 424 and a plurality of cavities 426*a*-426*e* with a cavity geometry configured to generate a toroidal vortex and at least one fluid sealing element 428*a*-428*e* in each of the cavities 426*a*-426*e* for inducing an azimuthal variation of the toroidal vortex. Note that, although five cavities 426*a*-426*e* and five fluid sealing element 428*a*-428*e* are indicated, this is for illustrative purposes only and should not be taken as an indication of a preferred embodiment. Further, when the single reference number is used to describe a cavity 426 or fluid sealing element 428, it may indicate one, some, or all of the cavities and fluid sealing element of the tool 422. As can be seen, the fluid sealing element 428 is step shape in the cavity 426. Note that, although only one step shape 428 is shown for each cavity 426, there may be more than one fluid sealing element 428 for each cavity 426 in the tool 422.

FIG. 4C is an illustration 440 including a tool 442 having an outer surface 444 and a plurality of cavities 446*a*-446*e* with a cavity geometry configured to generate a toroidal vortex and at least one fluid sealing element 448*a*-448*e* in each of the cavities 446*a*-446*e* for inducing an azimuthal variation of the toroidal vortex. Note that, although five cavities 446*a*-446*e* and five fluid sealing element 448*a*-448*e* are indicated, this is for illustrative purposes only and should not be taken as an indication of a preferred embodiment. Further, when the single reference number is used to describe a cavity 446 or fluid sealing element 448, it may indicate one, some, or all of the cavities and fluid sealing element of the tool 442. As can be seen, the fluid sealing element 448 is a notch in the cavity 446. Note that, although two notches 448 are shown for each cavity 446, there may be less than two or more than two fluid sealing element 448 for each cavity 446 in the tool 442.

Figure 5A:
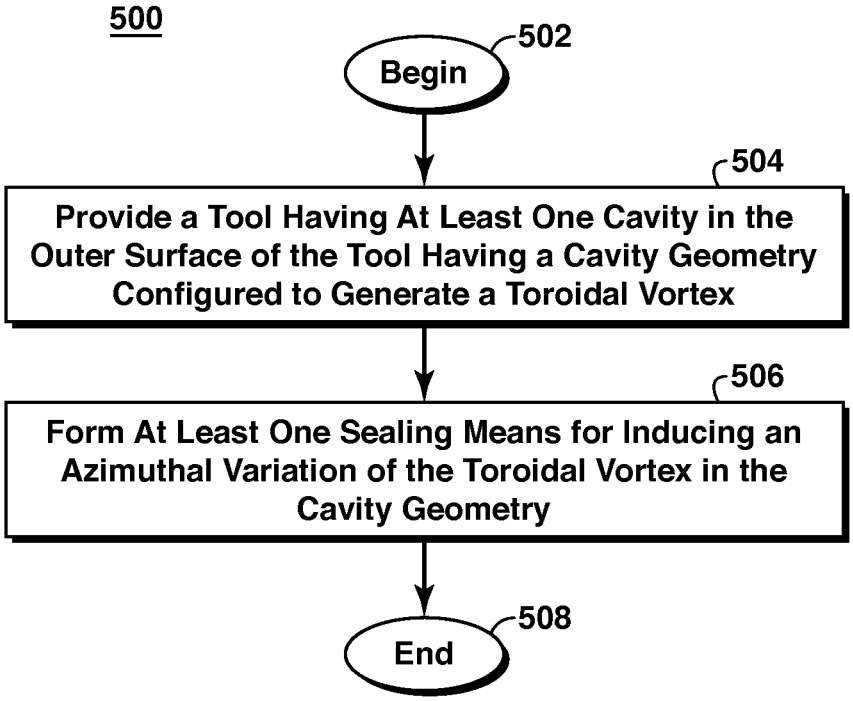
FIGS. 5A-5B show flow charts of alternative methods of manufacturing a tool such as the tools disclosed in FIGS. 3A-3C and FIGS. 4A-4C.
Figure 5B:
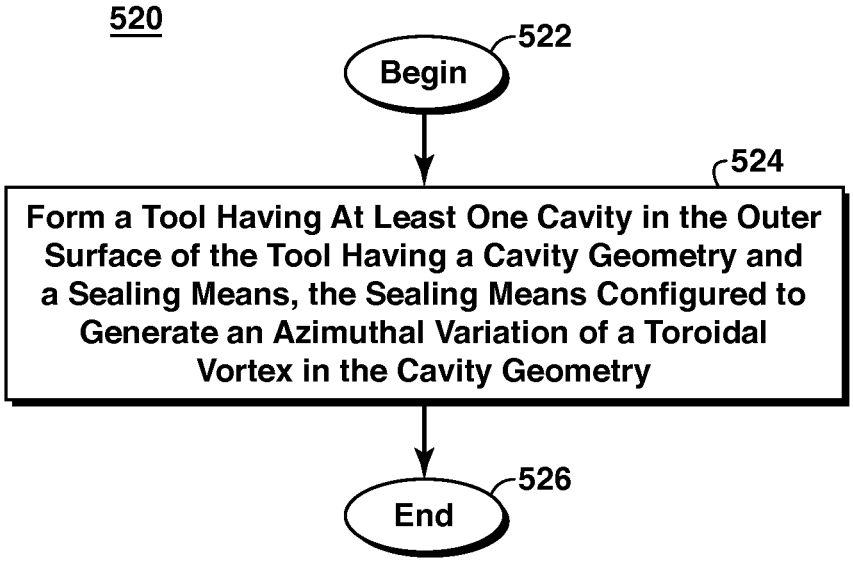

FIGS. 5A-5B show flow charts of alternative methods of manufacturing a tool such as the tools disclosed in FIGS. 3A-3C and FIGS. 4A-4C. As such, FIGS. 5A-5B may be best understood with reference to FIGS. 3A-3C and 4A-4C. In particular, FIG. 5A shows a method 500 of manufacturing a tool with a sealing mechanism, including beginning at block 502, then providing the tool 504, the tool having at least one cavity in the outer surface of the tool having a cavity geometry configured to generate a toroidal vortex, forming 506 at least one fluid sealing element for inducing an azimuthal variation of the toroidal vortex in the cavity geometry, and ending the process at block 508.

FIG. 5B shows a method 520 of manufacturing a tool with a sealing mechanism, including beginning at block 522, then forming 524 a tool having at least one cavity in the outer surface of the tool having a cavity geometry and a fluid sealing element, the fluid sealing element configured to generate an azimuthal variation of a toroidal vortex in the cavity geometry, and ending the process at block 526.

The tool of the method 500 may be tool 102 or any one of tools 302, 322, 342, 402, 422, or 442. In particular, the method 500 may be applied to tool 102 having cavities 106 for generating axially-symmetric toroidal vortexes 210, then modifying tool 102 to include notches, grooves, or other variations in the cavity geometry to induce an azimuthal variation of the toroidal vortexes. The method could also be applied for manufacturing a tool from scratch.

The tool of the method 520 may be any one of tools 302, 322, 342, 402, 422, or 442, but would not be used on tool 102. In manufacturing the disclosed tools by the disclosed methods, any manufacturing method known to persons of ordinary skill in the art may be employed including forming the tool using a mold, forming a tool with no cavities or fluid sealing element and cutting the shapes with a router or similar device, etching, and other techniques. Additional techniques may further include adding corrosion inhibiting coatings, low friction coatings such as diamond-like carbon, advanced ceramics (e.g. TiN, TiB2), near-frictionless carbon (NFC), TEFLON™, graphite, chemical-vapor deposition (CVD) diamond, and other such surface coatings.

The tool may be any type of tool configured to travel through a conduit that would benefit from having improved sealing in a gap between the tool and the conduit. However, some specific exemplary types of tools include: a plunger in an artificial lift type system in a gas production well, a pig used for removing wax or scale from subsea flow lines, and an in-flow control device for use in hydrocarbon production operations.

In one exemplary embodiment, the tool is a pig or cleaning pig. A pig is a solid object that runs along wells, flowlines, or pipes in order to remove wax or other depositions from the internal walls of the pipes. Pigs generally have cylindrical shapes that fit the internal diameter of the pipe, but without direct contact to the internal wall. The pig is deployed to reduce material accumulated on the internal surface of the pipe itself, a sufficient gap space has to be maintained between the pig and the pipe to avoid the pig getting stuck. However, in order to optimize the efficiency of the pig, a certain level of separation has to be maintained between the region upstream of the pig and the region downstream, whereby the flow of fluid along the gap between the pig and the pipe internal wall should be kept at a minimum. This represents a beneficial application of the disclosed fluid sealing element configured to induce an azimuthal variation of the toroidal vortex, which would increase the pressure drop along the gap between the pig and the pipe internal wall.

In another exemplary embodiment, the tool is an Inflow Control Device. In the petroleum industry, Inflow Control Devices (ICD) are used to identify completion hardware that can actively control the flow from the formation to the well and within the well. The most common type of ICD is constituted by a blank pipe with appropriately designed and appropriately placed nozzles that control the flow from the surrounding formation into the well. In more sophisticated designs, two concentric pipes with nozzles are present and the flow moves from the formation to the internal annular cavity between the two concentric pipes and then through additional nozzles into the well. The disclosed fluid sealing element configured to induce an azimuthal variation of the toroidal vortex can be beneficially applied to the internal annular cavity between the two concentric pipes. One advantage is a relaxation of the design constraint of the nozzles in the pipes. The largest portion of the pressure drop (which constitutes the "control" of the flow) is achieved by those nozzles, which makes them susceptible to reliability problems over the entire life-span of the completion. By introducing additional (and more controllable) pressure drop within the annular space, the nozzles may be designed with larger diameters and, consequently, with higher reliability. Another advantage is the ability to control the ensuing pressure drop. By an appropriate alignment between cavities in the two concentric pipes, the pressure drop can be fine-tuned. Another advantage is provided by the eventual capability of such hardware to selectively respond to gas and to liquid. The vortex generated with the axis in the longitudinal direction can effectively separate liquid from gas.

In yet another alternative embodiment, the tool is a plunger in an artificial lift type of system in a hydrocarbon well. In standard operation, the plunger travels down the well pulled by gravity and sinks into an accumulated water column. At the bottom of its travel path, some mechanism "seals" (or "locks") the plunger such that the plunger body constitutes a movable "plug," thus separating the region below the plunger from the region above it. While the gas is still being produced from the formation into the well, it does not bubble through the entire water column, but it stops and accumulates right below the locked plunger. When a sufficient pressure has been built below the plunger, it starts pushing up the plunger and the column of water that sits on the top of it.

Internally, the plunger has one or more longitudinal channels with various types of mechanisms that can open or close them. The plunger can thus switch between an "open" and a "sealed" configuration. The "open" configuration allows fluids to flow between bottom and top and makes the descent of the plunger in the well and into the water possible. In the "sealed" configuration, the internal channels are closed to fluids and the plunger acts as a plug between the region below and the region above the plunger. This way, a limited pressure differential can be maintained between the two regions, thus allowing the plunger to lift water by using build-up pressure from the formation.

The plunger remains in the "sealed" configuration during the portion of the operating cycle when it ascends the well while lifting a water column. In the ideal situation, the seal between the two regions is perfect and no fluid is exchanged as the plunger rises in the well. While the seal of the internal channels can be very effective, however, the clearance between the outer surface of the plunger and the walls of the well cannot be controlled as easily. The irregularities of the inside walls of a well that extends for hundreds if not thousands of feet can become significant, due to formation displacements, corrosion, or scaling. The clearance between the plunger and the walls of the well must therefore be sufficient to avoid any possibility of the plunger getting stuck. The sealing efficiency of the plunger is thus strongly reduced, with both water falling down and gas flowing up within that gap. As a twofold consequence, the lifted water column becomes smaller and the forces that drive the plunger up the well are reduced. The disclosed fluid sealing element configured to induce an azimuthal variation of the toroidal vortex can be beneficially applied to the plunger to increase the sealing efficiency between the plunger and the walls of the well to prevent the plunger from getting stuck and prevent the passage ("leakage") of water into the gas column and gas into the water column.

Figure 6:
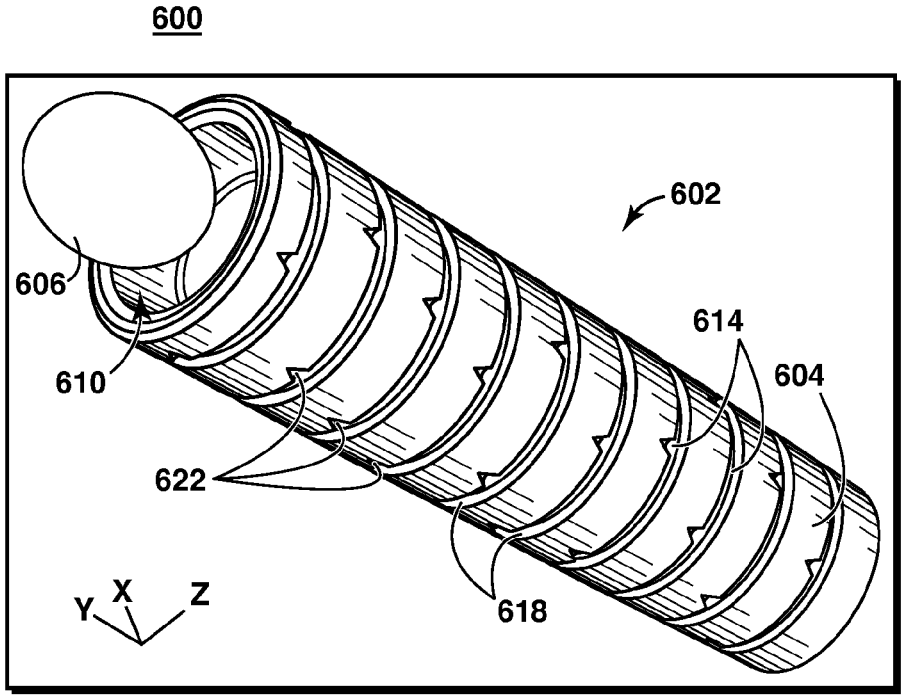
FIG. 6 is an illustration of an exemplary plunger having the sealing mechanisms disclosed in FIG. 4C.

FIG. 6 is an illustration of an exemplary plunger having the fluid sealing element disclosed in FIG. 4C. As such, FIG. 6 may be best understood with reference to FIG. 4C. Illustration 600 shows a plunger 602 in the open configuration including a cylindrical body 604, a plug (aka stopper or valve) 606, an opening 610 between the plug 606 and the cylindrical body 604, and a plurality of turbulent sealers 618 having dynamic sealing mechanisms 622.

Figure 7:
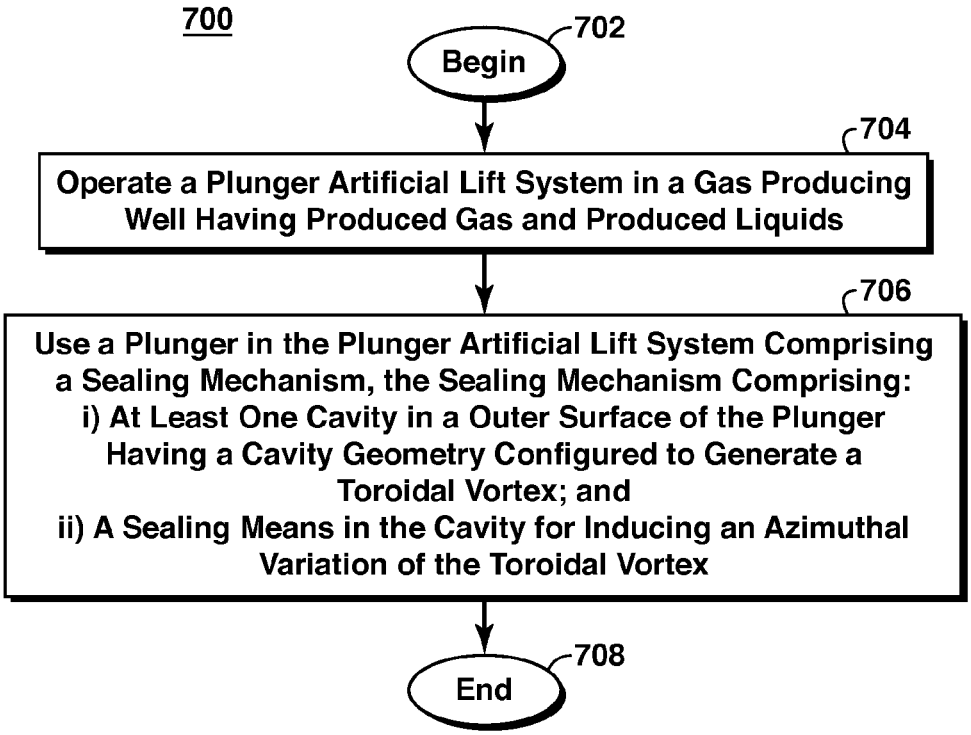
FIG. 7 shows a flow chart of a method of producing hydrocarbons using a tool like those disclosed in FIGS. 3A-3C and FIGS. 4A-4C.

FIG. 7 shows a flow chart of a method of producing hydrocarbons using a tool like those disclosed in FIGS. 3A-3C and FIGS. 4A-4C. As such, FIG. 7 may be best understood with reference to FIGS. 3A-3C and FIGS. 4A-4C. The process 700 begins at block 702 and includes operating 704 a plunger artificial lift system in a gas producing well having produced gas and produced liquid, using a plunger 706 in the plunger artificial lift system comprising a sealing mechanism, the sealing mechanism having at least one cavity in an outer surface of the plunger having a cavity geometry configured to generate a toroidal vortex and a fluid sealing element in the cavity for inducing an azimuthal variation of the toroidal vortex.

Modeling

Numerical modeling of the disclosed mechanisms and methods was performed to verify that the fluid sealing element operated in the theorized fashion and to determine some potential performance criteria for these fluid sealing element.

Figure 8A:
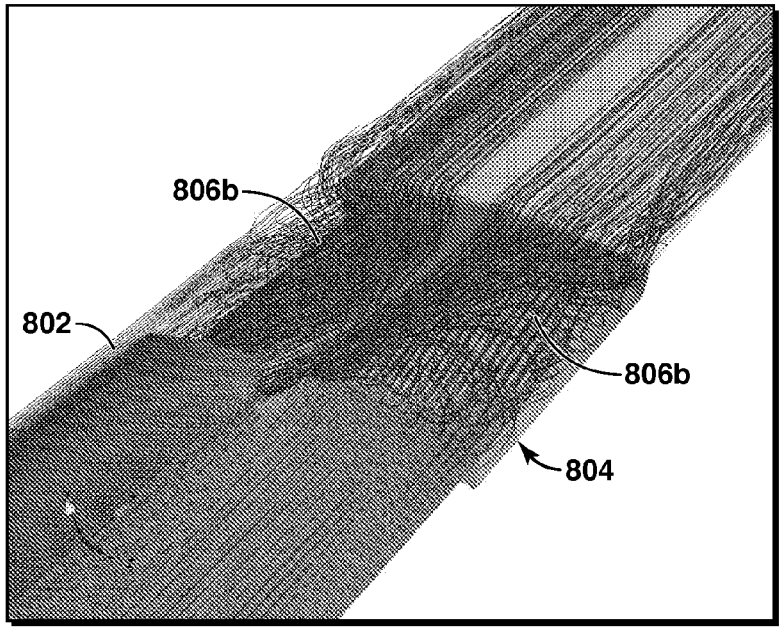
FIGS. 8A-8B are illustrations of numerical modeling results showing exemplary complex vortical structures generated by a disruption of the axial-symmetry of the cavity in accordance with the presently disclosed technology.
Figure 8B:
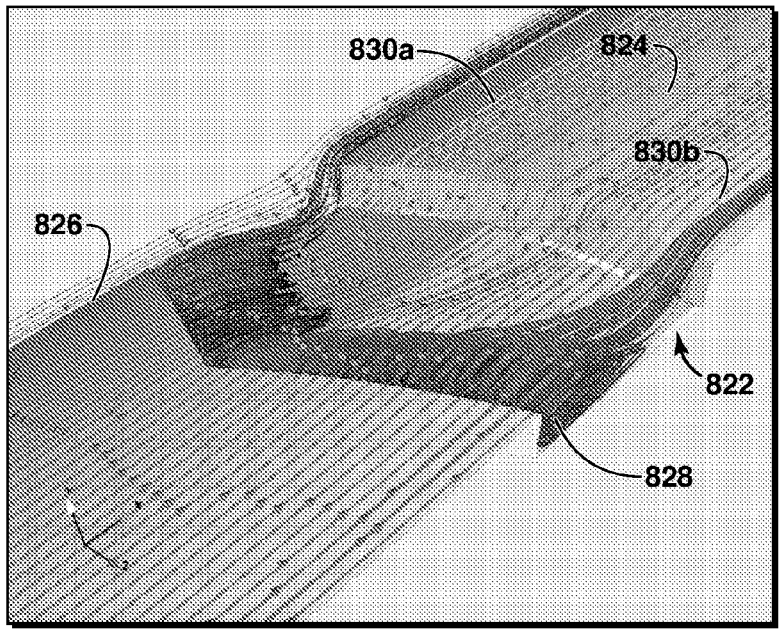

FIGS. 8A-8B are illustrations of numerical modeling results showing exemplary complex vortical structures generated by a disruption of the axial-symmetry of the cavity in accordance with the presently disclosed technology. In FIG. 8A, the illustration 800 includes a small cut 802 in the edge of the cavity 804 causing two vortices 806*a* and 806*b* to form and extend downstream of the cavity 804. It can be predicted that the increase in the complexity of the changes in the geometry of the cavity (such as multiple cuts and several changes in the direction of the cavity) is associated to an increase in the complexity of the induced vortical system. Consequently, the efficiency of the sealing capabilities is also increased.

FIG. 8B is an illustration 820 including a "V" shaped cavity 822 in a surface 824. The flow lines 826 show the flow of fluid and generation of vortices 828 as well as the interaction of the vortices beyond the cavity 830*a* and 830*b*.

Figure 9:
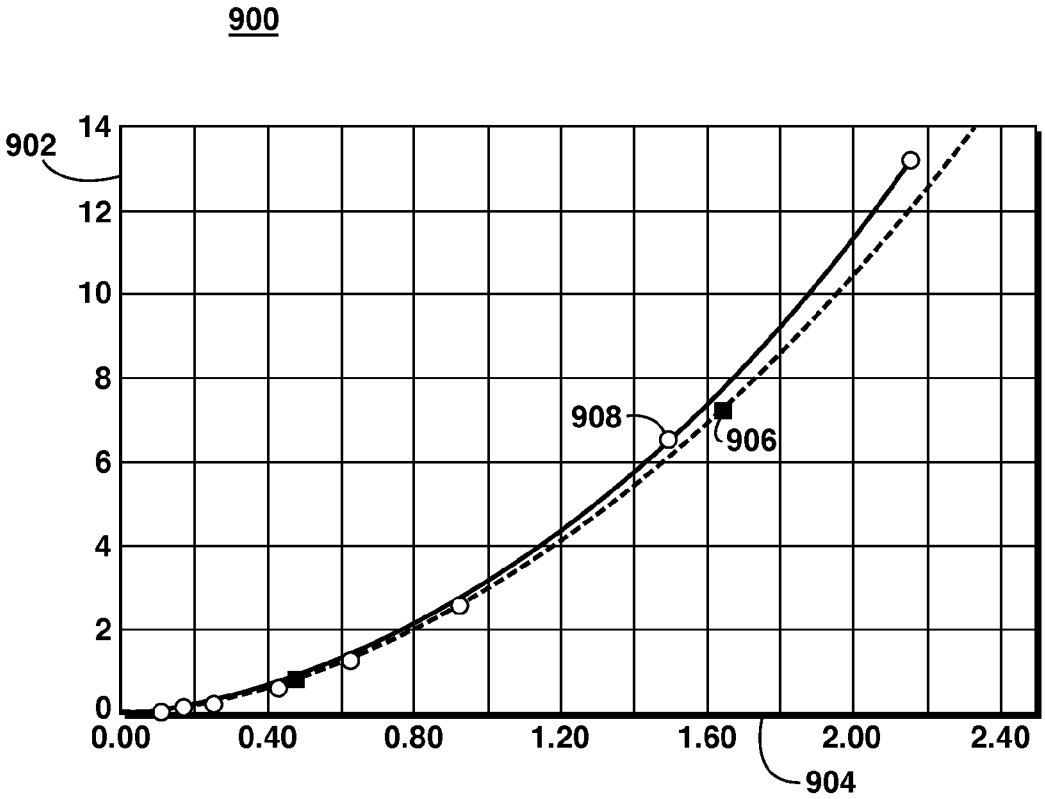
FIG. 9 is a graph displaying the result of a pressure drop calculation comparing the numerical model results of FIGS. 8A-8B to the flow in the gap of an axially-symmetric cavity (e.g. of FIG. 1).

FIG. 9 is a graph displaying the result of a pressure drop calculation comparing the numerical model results 800 and 820 to the flow in the gap of an axial symmetric cavity (e.g. tool 102). As such, FIG. 9 may be best understood with reference to FIGS. 8A-8B and FIG. 1. The graph 900 compares pressure 902 in pounds per square inch (psi) versus fluid flow rate 904 in cubic feet per second ($ft^3/s$). The plots on the graph 900 shows a plot of a tool with a standard turbulent sealer 906 and a plot of a tool with a sealing mechanism configured to induce an azimuthal variation of the toroidal vortex 908. As shown, the pressure drop along the gap increases by about 9% with the same flow rate. Although the curves refer to a specific size of the tool, dimensional analysis indicates that the resulting value of net performance (relative pressure drop increase) can be expected for any scaling of the given geometry. For example, scale ups or scale downs may be expected to have similar or identical performance when the Reynolds numbers are the same.

Furthermore, the increased complexity of the vortical structure caused by the disruption of the axial-symmetry in the cavity geometry carries an even more powerful effect. In the conventional turbulent sealer (shown in FIG. 1), one single vortex is housed in the cavity 106 and is stable. Once the structure of the vortex is disrupted, additional vortices arise having axis oriented in the direction of the flow and perpendicular to the cavity (e.g. 306, 326, or 346). As shown by the streamlines in illustrations 800 and 820, vortices appear that extend beyond the cavity (e.g. 804 or 822). If a second or subsequent cavity was present downstream, those vortices would interact with the vortices created by that second cavity. While the conventional turbulent sealers are cavities whose effect is independent, this new shape of the cavities allows for an incremental effect due to the coexistence of multiple cavities. The pressure loss due to a sequence of cavities, in other words, is not just the sum of the effects of the single cavities, but present an additional synergy between successive cavities ("interaction boost"). The quantification of this additional pressure drop due to the interaction effect of multiple cavities remains very difficult. The numerical simulations for such a complex topology are typically affected by a large numerical viscosity that tends to dissipate the vortices before they reach the next cavity, whereas in reality the dissipation of streamwise vortices occurs on a much longer time scale. However, the existence of such an effect has been sufficiently demonstrated.

Optimizations

Using the numerical simulations and results disclosed above with respect to FIGS. 8A-8B and 9, some additional design features are considered to increase the effect of vertical disruption and provide the most significant pressure drop along the length of a tool passing through a conduit.

In one particular exemplary embodiment, the cavity depth should be deep enough to generate a sufficient vertical system. Numerical experiments revealed that the cavity should be at least as deep as ½ of the estimated gap between the inside walls of the conduit and the body of the tool. Shallower cavities may not be able to constitute a sufficiently strong vortical system.

In another particular exemplary embodiment, the cavity length should be long enough to generate a sufficient vertical system. Numerical experiments suggest that an optimal length for the cavity should be around 1-½ times the gap between the inside walls of the conduit and the body of the tool. Shorter lengths may not allow for sufficiently strong vortical systems, whereas longer ones introduce instabilities that decrease the efficiency of the vortical system.

In yet another particular exemplary embodiment, the distance between successive cavities is as short as possible in order to take maximum advantage of the interaction effect of the vortical systems. Moreover, a higher number of cavities for the same overall length of the tool results in an increased pressure drop.

In a fourth exemplary embodiment, the shape of the sharp variation in the cavity is optimized. The additional three-dimensional vortices (toroidal vortices having an azimuthal variation) are generated by a sharp change of the leading edge of the cavity. Instead of following the azimuthal direction, sharp angles are present, as well as portions of the leading edge that are at least 30° away from the azimuthal direction.

In a fifth exemplary embodiment, the number of sharp variations is optimized. A large number of sharp variations of the shape along the azimuthal direction lead to an increased complexity of the vortical structure. However, a lower limit can be set in the proximity of the generated three-dimensional vortices, since interactions between those vortices in the same cavity may reduce the overall energy content of the vortical system. In particular, for a 2" diameter tool, it is suggested not to exceed 6 points with a sharp angle on the leading edge of the cavity.

In a sixth exemplary embodiment, additional constraints for successive cavities may be provided. When two cavities are present, the azimuthal location of the sharp angles should preferably be mis-aligned. The three-dimensional disruptions generated by the first cavity extend directly downstream and could reduce the efficiency of the following sharp angle, if they are aligned.

While the present disclosure may be susceptible to various modifications and alternative forms, the exemplary embodiments discussed above have been shown only by way of example. However, it should again be understood that the disclosure is not intended to be limited to the particular embodiments disclosed herein. Indeed, the present disclosure includes all alternatives, modifications, and equivalents falling within the true spirit and scope of the appended claims.

What is claimed is:

1. A sealing mechanism, comprising:

a tool having at least one cavity in an outer surface of the tool having a cavity geometry configured to generate a toroidal vortex comprising an axial symmetry; and a fluid sealing element in the cavity configured to induce an azimuthal variation of the axial symmetry of the toroidal vortex.

2. The mechanism of claim 1, wherein the tool has a cylindrical shape and an axial length and is configured to move within an inside surface of a conduit at a linear velocity with respect to the conduit and form a gap between the outer surface of the tool and the inner surface of the conduit.

3. The mechanism of claim 2, wherein the fluid sealing element is a sharp disruption of an axial symmetry of the cavity geometry.

4. The mechanism of claim 3, wherein the sharp disruption is a change in an orientation of the cavity geometry of at least about 30° from the direction of azimuthal symmetry.

5. The mechanism of claim 4, wherein the sharp disruption is positioned on the cavity at a location selected from the group consisting of: a front edge of the cavity; a back edge of the cavity; a depth of the cavity; and any combination thereof.

6. The mechanism of claim 2, further comprising multiple cavities with each cavity having multiple fluid sealing elements, wherein the fluid sealing element of a first cavity is not in axial alignment with the fluid sealing element of a successive cavity.

7. The mechanism of claim 1, wherein the fluid sealing element is selected from the group consisting of: a step shape, a "V" shape, a notch, and any combination thereof.

8. The mechanism of claim 7, wherein:

i) the cavity is at least as deep as one half of the gap; and ii) the cavity has an axial length parallel to the axial length of the tool and the axial length of the cavity is about 1.5 times the gap.

9. The mechanism of claim 1, wherein the tool comprises at least one of a plunger, a pipeline, and an inflow control device includes at least one of a well production tubing, a pig, and an inflow control device.

10. The mechanism of claim 1, wherein the conduit includes at least one of a well production tubing, a pig, and an inflow control device.

11. A method of manufacturing a tool with a sealing mechanism, comprising:

providing the tool, the tool having at least one cavity in the outer surface of the tool having a cavity geometry configured to generate a toroidal vortex comprising an axial symmetry;

and forming at least one fluid sealing element for inducing an azimuthal variation of the axial symmetry of the toroidal vortex in the cavity geometry.

12. A method of manufacturing a tool with a sealing mechanism, comprising:

forming a tool having at least one cavity in the outer surface of the tool having a cavity geometry and a fluid sealing element, the fluid sealing element configured to generate an azimuthal variation of axial symmetry of a toroidal vortex in the cavity geometry.

13. The method of claim 12, wherein the tool has a cylindrical shape and an axial length and is configured to move within an inside surface of a conduit at a linear velocity with respect to the conduit and form a gap between the outer surface of the tool and the inner surface of the conduit.

14. The method of claim 13, wherein the fluid sealing element is a sharp disruption of an axial symmetry of the cavity geometry.

15. The method of claim 14, wherein the sharp disruption is positioned on the cavity at a location selected from the group consisting of: a front edge of the cavity; a back edge of the cavity; a depth of the cavity; and any combination thereof.

16. The method of claim 13, wherein the tool is a plunger configured to travel through a high rato gas producing well.

17. The method of claim 13, further comprising multiple cavities with each cavity having multiple fluid sealing elements, wherein the fluid sealing element of a first cavity is not in axial alignment with the fluid sealing element of a successive cavity.

18. The method of claim 17, wherein the fluid sealing element is selected from the group consisting of: a step shape, a "V" shape, a notch, and any combination thereof.

19. The method of claim 18, wherein:

i) the cavity is at least as deep as one half of the gap; and ii) the cavity has an axial length parallel to the axial length of the tool and the axial length of the cavity is about 1.5 times the gap.

20. The method of claim 18, further comprising multiple cavities with each cavity having multiple fluid sealing elements, wherein the fluid sealing element of a first cavity is not in axial alignment with the fluid sealing element of a successive cavity.

21. The method of claim 12, wherein the fluid sealing element is a change in an orientation of the cavity geometry of at least about 30° from the direction of azimuthal symmetry.

22. The method of claim 12, wherein the fluid sealing element is a notch in a leading edge of the cavity.

23. The method of claim 12, wherein the fluid sealing element is selected from the group consisting of: a step shape in the cavity geometry, a "V" shape in the cavity geometry, a notch in the cavity geometry, and any combination thereof.

24. The method of claim 23, wherein:

i) the cavity is at least as deep as one half of the gap; and ii) the cavity has an axial length parallel to the axial length of the tool and the axial length of the cavity is about 1.5 times the gap.

25. A method of producing hydrocarbons, comprising:

operating a plunger artificial lift system in a gas producing well having produced gas and produced liquids;

using a plunger in the plunger artificial lift system comprising a sealing mechanism, the sealing mechanism comprising:

at least one cavity in an outer surface of the plunger having a cavity geometry configured to generate a toroidal vortex comprising an axial symmetry; and a fluid sealing element in the cavity for inducing an azimuthal variation of the axial symmetry of the toroidal vortex.

26. The method of claim 25, wherein the fluid sealing element is a sharp disruption of an axial symmetry of the cavity geometry.

27. The method of claim 26, wherein the sharp disruption is a change in an orientation of the cavity geometry of at least about 30° from the direction of azimuthal symmetry.

28. The method of claim 27, wherein the sharp disruption is positioned on the cavity at a location selected from the group consisting of: a front edge of the cavity; a back edge of the cavity; a depth of the cavity; and any combination thereof.

* * * * *